United States Patent [19]

Sullivan

[11] Patent Number: 5,000,094

[45] Date of Patent: Mar. 19, 1991

[54] SHOTGUN CARTRIDGE WITH EXPLOSIVE SHELL

[76] Inventor: Leroy J. Sullivan, 19567 Vaiile Cir., Huntington Beach, Calif. 92646

[21] Appl. No.: 907,736

[22] PCT Filed: Dec. 17, 1985

[86] PCT No.: PCT/EP85/00718

§ 371 Date: Aug. 21, 1986

§ 102(e) Date: Aug. 21, 1986

[87] PCT Pub. No.: WO86/03826

PCT Pub. Date: Jul. 3, 1986

[30] Foreign Application Priority Data

Dec. 21, 1984 [GB] United Kingdom ..... 8432437

[51] Int. Cl.[5] ..... F42B 5/00; F42B 7/10; F42B 12/04; F42B 12/10

[52] U.S. Cl. ..... 102/439; 102/222; 102/448; 102/473; 102/476; 102/491; 102/532

[58] Field of Search ..... 102/439, 221, 222, 376, 102/473, 448, 476, 491–493, 503, 532, 499

[56] References Cited

U.S. PATENT DOCUMENTS

| | | | |
|---|---|---|---|
| H203 | 3/1987 | Thomas et al. | 102/473 |
| 133,714 | 12/1872 | Mean, Jr. | 102/430 |
| 1,959,737 | 5/1934 | Rigsby | 102/491 |
| 2,365,708 | 12/1944 | Landen . | |
| 2,764,092 | 9/1956 | Massey . | |
| 3,062,144 | 11/1962 | Hori et al. . | |
| 3,580,174 | 5/1971 | Apotheloz et al. | 102/476 |
| 3,820,463 | 6/1974 | Leonard et al. | 102/439 |
| 3,967,553 | 7/1976 | Keraus et al. | 102/476 |
| 4,459,915 | 7/1984 | Lynch | 102/473 |
| 4,538,520 | 9/1985 | Schmitz | 102/439 |
| 4,913,054 | 4/1990 | Peterson | 102/439 |

FOREIGN PATENT DOCUMENTS

| | | |
|---|---|---|
| 866294 | 7/1941 | France . |
| 1521487 | 4/1968 | France . |
| 493818 | 8/1970 | Switzerland . |

*Primary Examiner*—Harold J. Tudor
*Attorney, Agent, or Firm*—Needle & Rosenberg

[57] ABSTRACT

A shotgun cartridge (1) has an armour piercing shell (11) which includes a main charge (17) arranged to be detonated or exploded by direct percussion of a primer (12). The cartridge (1) includes a bore safe cylindrical arming device (16) integrally formed with the obturator (6), which interrupts the detonation process after detonation of the primer (12). The arming device (16) is arranged to separate from the shell, to arm the shell, after firing of the shell (11) from the barrel of a gun, and the shell (11) includes an open base or rear portion to prevent shrapnel being thrown to the rear on detonation.

19 Claims, 1 Drawing Sheet

SHOTGUN CARTRIDGE WITH EXPLOSIVE SHELL

The invention relates to shotgun cartridges having an explosive armour piercing shell which can be produced economically and which can be fired safely from a conventional shotgun.

Modern impact explosive shells have a "bore safe" arming mechanism, i.e. one which prevents the shell from being detonated in the gun barrel and which arms the shell, to prepare it to explode on impact, after it has travelled far enough to explode without damaging the gun or gunner. The distance at which the shell can be armed safely is dependant on the size of the shell (due to the magnitude of the explosion) and the amount of shrapnel and debris which is hurled rearwards towards the gunner on explosion. These mechanisms are generally complex and expensive and they occupy a significant volume in the shell thereby reducing the volume of the main explosive charge.

Were it not for the requirement for a "bore safe" arming mechanism and for arming to take place only after the shell has travelled a safe distance, the detonating device could be a simple primer in the nose of the shell which would detonate from the percussion caused on impact. In conventional shells simple impact primers cannot be used. Known arming mechanisms use a firing pin or hammer mechanism within the shell for mechanical detonation or, alternatively, a piezo-electric crystal to generate electricity on impact. Both of these types of systems can be inhibited or held inoperable by the arming mechanism and both allow the detonation to be located at the rear of the main explosive charge, necessary in particular for detonation of shaped explosive charges. Unfortunately, both systems add complexity and cost to the shell and a further disadvantage of the mechanical systems is that they are relatively slow acting. Although piezo-electric systems are faster they are not instantaneous not related to the speed of electricity. This is because the metallic element inside the detonator requires current for a significant time before it is hot enough to cause detonation.

If a shaped charged is used then a long projection, usually an empty cylinder or cone, is added to the front of the explosive charge of the shell so that detonation occurs before the charge has been able to travel the length of the projection. Were this not the case, then if the face of the charge impacted before detonation, the conical shape of the charge would be distorted and its armour penetration effect, known as the Monroe effect, would be lost.

Clearly, the fastest possible ignition times will be achieved with direct percussion of a primer which, once initiated, enables detonation to progress through a high explosive chain so rapidly that no projection stand off is needed. This would have the added advantage of being simple and cheap to produce. However, the problem is to control such a detonation device with a simple and reliable "bore safe" arming device.

According to a first aspect of the present invention a shotgun cartridge has an armour piercing shell which includes a main charge arranged to be detonated or exploded by direct percussion of a primer the cartridge including a bore safe arming device, characterized in that the arming device is arranged to interrupt the detonation process after detonation of the primer.

According to a second aspect of the present invention a shotgun cartridge has an armour piercing shell which includes a main charge arranged to be detonated or exploded by direct percussion of a primer, the cartridge including bore safe arming device, characterized in that the arming device is arranged to separate from the shell, to arm the shell, after firing of the shell from the barrel of a gun.

According to a third aspect of the present invention a shotgun cartridge has an armour piercing shell which includes an open base or rear portion to prevent shrapnel being thrown to the rear on detonation.

The arming mechanism may comprise a cylindrical element disposed within the main charge and arranged to be withdrawn from the main charge after firing of the shell from the cartridge.

Preferably the main charge has a cylindrical bore extending longitudinally therethrough and surrounding the cylindrical element.

The cylindrical element may be integrally formed with an obturator located between the shell and main charge and a firing charge for firing the shell from the cartridge, and the obturator may be a unitary plastics wad having rear and forward discs and collapsible spacer legs therebetween, the integral cylindrical element extending from the front of the front disc.

Preferably, a secondary detonator is located annularly around the arming device, and the main charge can be a shaped charge having a substantially frustoconical concave front face.

Advantageously, the primer comprises a cylindrical casing having a detonator at its front end, the rear of the casing extending at least partially into the arming device. The primer may comprise a rimfire casing.

The cartridge may have a casing which has a crimped front end which extends forward of the primer to prevent any detonation of the primer by accidental dropping of the cartridge prior to loading into the shotgun.

The present invention. utilizes a chain of explosive detonations whose relative sensitivity and location cause them to detonate in a given sequence which can be interrupted by the presence of a plug comprising part of the bore safe arming device.

One example of an armour-piercing shotgun shell constructed in accordance with the present invention will now be described with reference to the accompanying informal drawings in which:

FIG. 1 shows a loaded shotgun cartridge 1 having the external dimensions of a standard $2\frac{3}{4}$" 12-bore cartridge, capable of functioning in any 12-bore shotgun having an open choke barrel (i.e. cylindrical bore).

Figure 1:
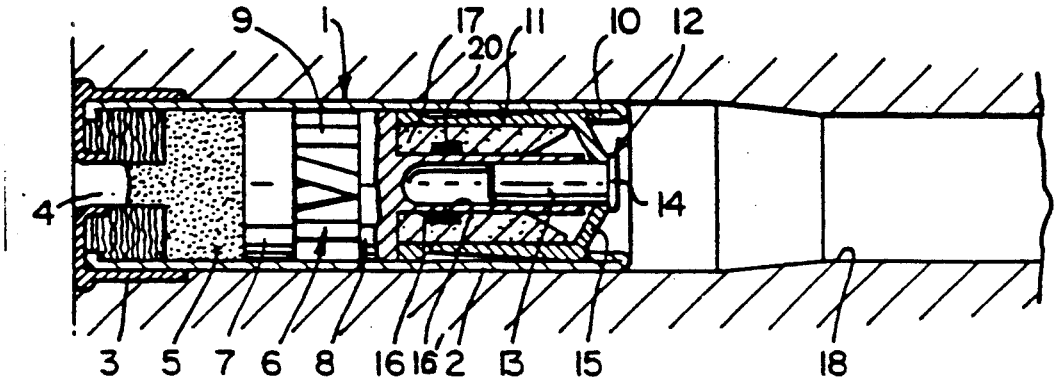
FIG. 1 shows a partially longitudinally sectioned view of a shotgun cartridge in the chamber of a shotgun.

The cartridge 1 has a conventional cylindrical casing 2 and rear end cap 3 with detonator 4. Like most modern shotgun cartridges the explosive charge 5 for firing the projectile bears against a collapsible plastic wad or obturator 6 which has rear and forward discs 7,8 and collapsible spacer legs 9.

The front end of the casing 2 has a conventional roll-over crimp 10 to retain a generally cylindrical projectile or shell 11. The shell 11 has a primer 12, which in the present case comprises a conventional rimfire casing 13 with detonator cap 14, the primer 12 extending through a circular aperture formed in a frusto-conical front portion 15 of the shell 11.

Unlike conventional plastic wads, the wad 6 has a forward projection 16 which extends into the shell 11 around the cylindrical portion of the primer 12. This cylindrical portion 16 comprises the "bore safe" plug or arming device which, while in position as shown, "masks" the detonation of the primer 12 preventing detonation of the main explosive charge 17 which is packed around the plug 16 and which comprises a "shaped" charge to achieve the armour piercing effect on detonation. The main charge 17 has a central longitudinal bore 16' in which the plug 16 is fitted. The plug 16 masks detonation of the primer by preventing the shock wave from the primer from reaching a secondary detonator 20 positioned internally of the main charge 17, closely spaced annularly around the plug 16 or positioned without spacing around the plug 16. The secondary detonator 20 is arranged to be more sensitive than the main charge and has to be detonated in order to detonate the main charge.

It can be seen that the crimp 10 protrudes forward of the percussion cap 14 of the primer 12 and this prevents any detonation of the primer by accidental dropping of the cartridge prior to loading into the shotgun.

Figure 2:
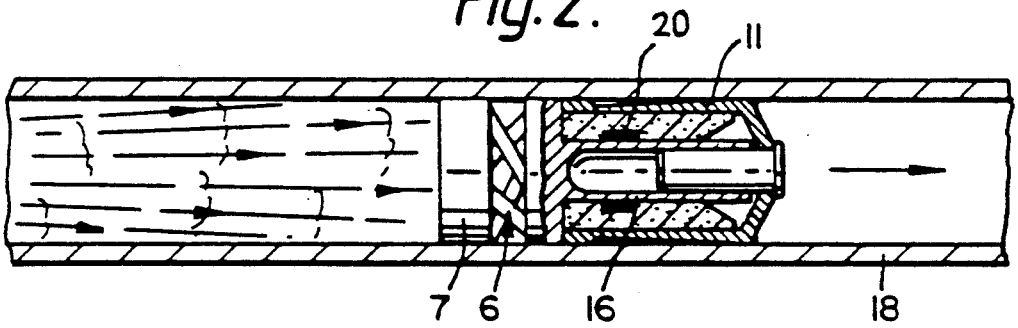
FIG. 2 shows the shell of the cartridge in the barrel of the shotgun immediately after firing; and, FIG. 3 shows the shell at a time after it has left the barrel of the gun and before impact.

When the cartridge is fired the crimp 10 is unrolled by the forward motion of the shell 11, the shell being accelerated through the barrel 18 (see FIG. 2) by gas pressure acting on the rear of the wad 6 and the "bore safe" plug 16 being held in position by the same gas pressure. Therefore, were there to be an obstruction in the barrel, and the primer 12 detonated on impact with the obstruction, neither the secondary detonator 20 nor the main charge would be set off. Consequently, there is no opportunity or circumstance for the main charge or shell to explode while it is in the gun.

Figure 3:
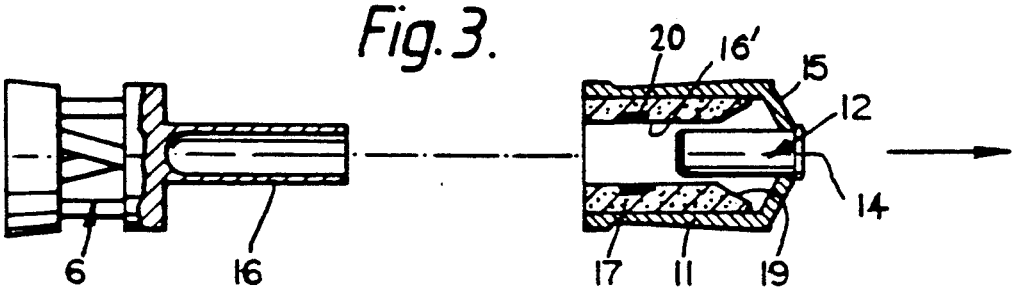

After the shell 11 and plastic wad 6 fly out of the barrel together there is no longer any gas pressure holding the wad 6 against the shell 11 and because of the high speed and the fact that it meets substantial wind resistance, the lightweight plastic wad is soon left behind (see FIG. 3). As the wad 6 separates from the shell 11 (which is heavier and therefore less affected by wind drag) the plastic wad 6 withdraws the "bore safe" plug 16 from within the shell and from within the main charge so that the shell thereafter is armed and will explode on impact when the primer 12 is detonated, in turn detonating the secondary detonator 20.

Separation will preferably be arranged to occur at 10 to 50 feet beyond the gun and since there is no solid base on the shell, shrapnel from the shell casing will be thrown only radially outwardly and forward, but not rearwards towards the gun. Thus, the explosion of the shell 11 is safe to the gunner even at relatively short distances.

The mechanism of explosion on impact is that the rimfire primer 12 detonates a small high explosive charge within the rimfire cartridge which throws a high velocity shock wave rearwards and outwards into the empty cavity formed by the conical face 19 of the main charge 17. The magnitude of the shock wave is too low to detonate the relatively insensitive main charge, and part of the shock wave continues rearwards through the bore 16' in the main charge until it reaches and detonates the more sensitive detonator 20 which detonates the main charge 17 due to its direct contact with it. The detonation through the main charge 17 moves forward to the conical face 19 which then concentrates the energy into a single line of intense high pressure, high temperature gas which penetrates the target. This concentration of energy is called the "Monroe effect" and is common to all shaped charges.

While the detonation progresses through the explosive chain, the front of the shell is collapsing from impact with the target. Detonation must be complete before the front of the shell collapses rearward far enough to distort the shape of the conical face 19 of the charge needed for the Monroe effect. This is readily achieved as the slowest event in the explosive chain is the shock wave, which can travel at around 38,000 feet per second and is thus approximately 32 times faster than the velocity of the shell and its maximum rate of collapse. The shell can be seen therefore to be proportioned so that there is a generous time margin to allow completion of detonation before the shaped charge is deformed.

Unlike all known conventional shells which are slow to initiate detonation, the invention begins detonation on impact even in the "bore safe" condition. However, the "bore safe" plug simply interrupts and stops the detonation before it can set off the main charge. Whilst this may seem unsafe, it is impossible for the bore safe plug to move backwards out of position until the shell has left the gun barrel and the cartridge is therefore inherently safe.

I claim:

1. A armour piercing shell, having forward and rearward sections, comprising:

a tubular main charge located within said shell;

a primer means for detonating said main charge by direct percussion located within said main charge in the forward section of said armour piercing shell; and a detachable bore-safe arming device which comprises a tubular element which, in the normal prefired state, is disposed within said main charge and surrounds said primer means to interrupt the detonation of said main charge by detonation of said primer means, and which, after firing of said armour piercing shell from the barrel of a gun, is completely rearwardly detachable from the armour piercing shell during flight, thereby allowing detonation of said main charge by said primer means on impact.

2. An armour piercing shell according to claim 1, wherein said armour piercing shell has an open base or rear portion to prevent shrapnel being thrown to the rear on detonation.

3. An armour piercing shell according to claim 1, wherein said bore-safe arming device is cylindrical and said main charge has a cylindrical bore extending longitudinally therethrough and surrounding said bore-safe arming device.

4. An armour piercing shell according to claim 1, wherein a secondary detonator is located annularly around said bore-safe arming device.

5. An armour piercing shell according to claim 3, wherein a secondary detonator is located annularly around said bore-safe arming device.

6. An armour piercing shell according to claim 1, wherein said main charge is a shaped charge having a substantially frusto-conical concave front face.

7. An armour piercing shell according to claim 2, wherein said main charge is a shaped charge having a substantially frusto-conical concave front face.

8. An armour piercing shell according to claim 6, wherein said primer means comprises a cylindrical casing having a detonator at its front end.

9. An armour piercing shell according to claim 8, wherein said primer means comprises a rimfire casing.

10. A shotgun cartridge comprising:

a casing;

a propellant; and an armour piercing shell, having forward and rearward sections, comprising:

a tubular main charge located within said shell;

a primer means, for detonating said main charge by direct percussion, located within said main charge in the forward section of said armour piercing shell; and a detachable bore-safe arming device which comprises a tubular element which, in the normal prefired state, is disposed within said main charge and surrounds said primer means to interrupt the detonation of said main charge by detonation of said primer means, and which, after firing of said armour piercing shell from the barrel of a gun, is completely rearwardly detachable from the armour piercing shell during flight, thereby allowing detonation of said main charge by said primer means on impact.

11. A shotgun cartridge according to claim 10, wherein said armour piercing shell has an open base or rear portion to prevent shrapnel being thrown to the rear on detonation.

12. A shotgun cartridge according to claim 10, wherein said bore-safe arming device is cylindrical and said main charge has a cylindrical bore extending longitudinally therethrough and surrounding said bore-safe arming device.

13. A shotgun cartridge according to claim 10, wherein said bore-safe arming device is integrally formed with an obturator located between said armour piercing shell and said propellant for firing said shell from the cartridge.

14. A shotgun cartridge according to claim 13, wherein said obturator comprises a unitary plastics wad having rear and forward discs and collapsible spacer legs therebetween, the integral bore-safe arming device extending from the front of the front disc.

15. A shotgun cartridge according to claim 10, wherein a secondary detonator is located annularly around said bore-safe arming device.

16. A shotgun cartridge according to claim 10, wherein said main charge is a shaped charge having a substantially frusto-conical concave front face.

17. A shotgun cartridge according to claim 10, wherein said primer means comprises a cylindrical casing having a detonator at its front end.

18. A shotgun cartridge according to claim 17, wherein said primer means comprises a rimfire casing.

19. A shotgun cartridge according to claim 10, wherein said cartridge has a casing which has a crimped front end which extends forward of said primer means to prevent any detonation of said primer means by accidental dropping of said cartridge.

* * * * *